United States Patent [19]

Ono

[11] 4,135,470

[45] Jan. 23, 1979

[54] AQUATIC VEHICLE

[76] Inventor: Hiroshi Ono, 4326 W. Division St., Chicago, Ill. 60651

[21] Appl. No.: 466,802

[22] Filed: May 3, 1974

Related U.S. Application Data

[63] Continuation-in-part of Ser. No. 286,715, Sep. 6, 1972, abandoned.

[51] Int. Cl.[2] ..... B63B 35/72

[52] U.S. Cl. ..... 115/70; 115/39; 115/42; 180/5 R

[58] Field of Search ..... 115/70, 39, 42, 1 R, 115/6.1, 12 R; 114/62, 57, 66.5 R, 66.5 H, 274, 288, 290; 9/310 R, 310 A, 310 C, 310 E; 180/5 R; 280/21 R, 21 A; D12/69

[56] References Cited

U.S. PATENT DOCUMENTS

| | | | |
|---|---|---|---|
| D. 157,564 | 3/1950 | Byerly | 9/310 E |
| 2,708,759 | 5/1955 | Strawn | 115/6.1 |
| 2,940,409 | 6/1960 | Chaffee | 115/70 |
| 3,080,585 | 3/1963 | Marble | 9/310 A |
| 3,158,129 | 11/1964 | Mauer | 115/70 |
| 3,319,276 | 5/1967 | Penney | 9/310 A |
| 3,358,635 | 12/1967 | McRee | 115/6.1 |
| 3,530,950 | 9/1970 | Lamb | 280/21 A |
| 3,626,428 | 12/1971 | Collaro | 9/310 E |

*Primary Examiner*—Trygve M. Blix
*Assistant Examiner*—Sherman D. Basinger

[57] ABSTRACT

A rider-balanced aquatic vehicle has a body with a seat for supporting a rider and a motor which provides propulsion for the vehicle, the front end of the body being supported by a steerable front ski and the rear end being supported by a hydraulic lifting surface on the lower surface of the body. A steering shaft is operatively connected to the front ski to control the attitude of the front ski for assisting in controlling the balance and direction of motion of the vehicle. The front ski is horizontally transversely pivoted and spring biased toward an upward and forward attitude, resulting in increased lift upon the initial movement of the vehicle and efficient planing when the vehicle is in motion. The lifting surface at the rear of the vehicle incorporates a tapering tunnel portion formed in the lower surface of the body and outwardly and downwardly extending wings joined to the side edges of the tunnel portion. The wings provide lift during straight running, but do not interfere substantially with the ability of a rider to roll the vehicle by leaning, and the tunnel gives increased lift to the rear of the vehicle during banked turns.

28 Claims, 27 Drawing Figures

Fig. 13.
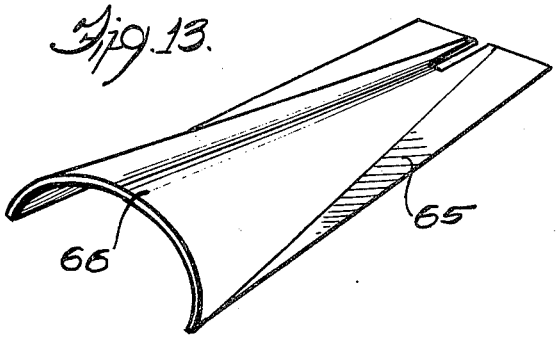
Fig. 16.
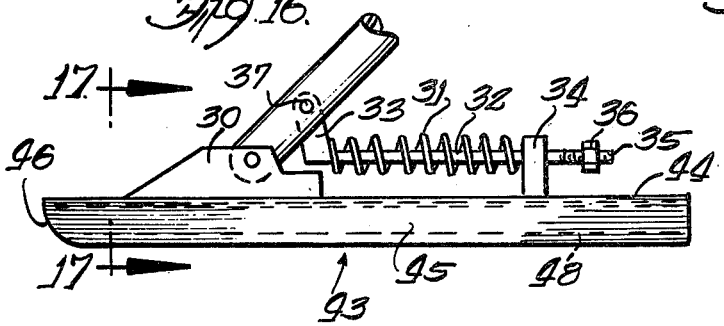
Fig. 17.
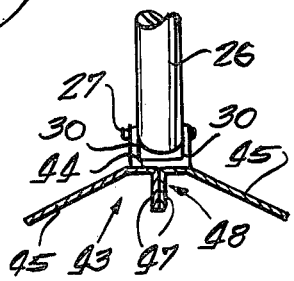
Fig. 14.
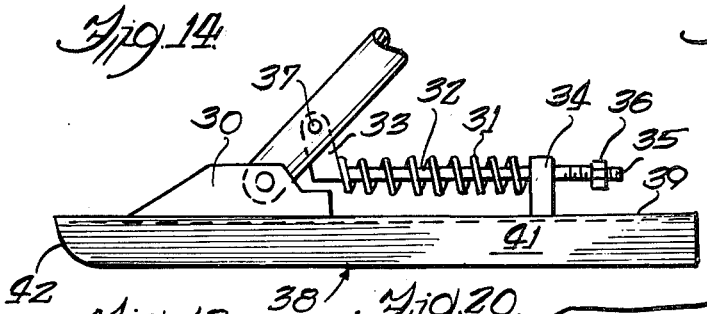
Fig. 15.
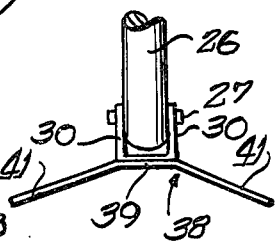
Fig. 18.
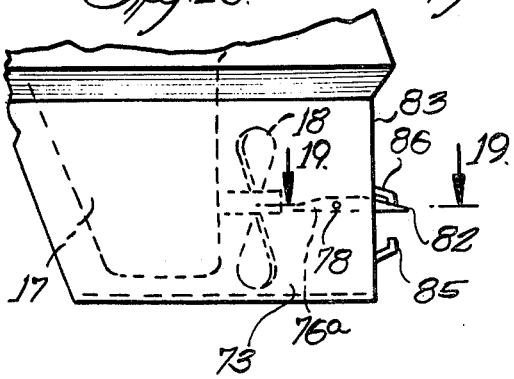
Fig. 20.
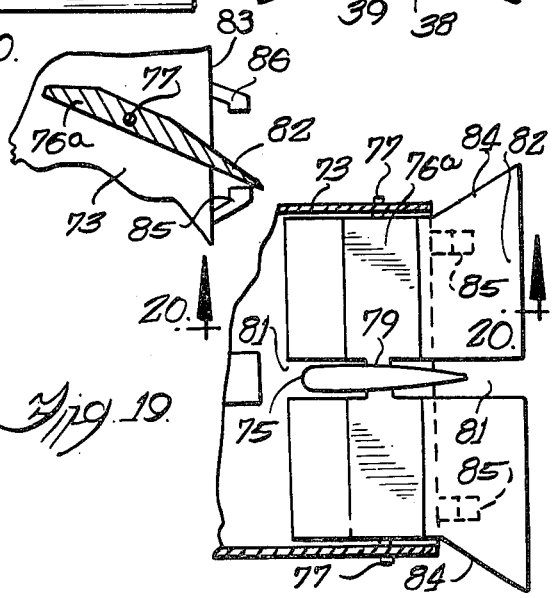
Fig. 19.

AQUATIC VEHICLE

BACKGROUND

1. Field of the Invention

This is a continuation-in-part application, based on copending Ser. No. 286,715, filed Sept. 6, 1972, and now abandoned.

The present invention relates to an aquatic vehicle, and more particularly to a motor-propelled water vehicle in which the vehicle may be banked and turned at least partially by the rider leaning toward the inside of a turn, similar to a motorcycle.

2. The Prior Art

In recent years, water sports have increased in popularity. Due to the expense of pleasure boats and the need of a powerful motorboat and a driver to pull a skier in water skiing, these sports are out of reach to many potential participants. As a result, a variety of attempts have been made to design more compact watercraft, which are suitable for use by only one or two persons, and which are small in size so that their cost in minimized. None of these attempts has met with unqualified success, however, for a variety of reasons. Some of the watercraft are incapable of more than only a moderate speed, and so do not give the same sensation of speed as a motorboat. Others are capable of reasonably high speeds only during straight running, and cannot be made to turn sharply, or else they become highly unstable during sharp turns, effectively preventing the execution of such turns.

The attempts in the prior art to produce small size watercraft have adopted several different lines of approach, but none of the approaches heretofore adopted has been free of disadvantages. In one approach, pontoons are used as buoyant elements for producing the required lift to prevent the watercraft from sinking, and the pontoons remain on the water surface at all times so that there is little vertical motion, relative to the water surface, at a variety of speeds. It is substantially impossible to execute banked turning maneuvers with such craft, and turns are restricted to shallow turns, the turns being typically stabilized by one or more keels with the use of a rudder or a pivotable propulsion unit. Such a craft also requires a very calm water surface, because the pontoons tend to follow the surface of any wave, resulting in a severe pitching in rough water.

In another approach, small watercraft have been provided with planing surfaces held well below the body of the vehicle so that the body of the vehicle is raised out of the water as speed is increased from a standstill, with planing surfaces supporting the weight of the vehicle. In one such vehicle, fixed planing surfaces are provided forward and aft which are relatively long and narrow. The vehicle is steered by adjusting the direction of a water jet issuing from a propulsion unit near the rear of the vehicle. Another vehicle, which also has planing surfaces in the form of long narrow skis, has the rear ski fixed in position, with the propeller of a propulsion unit supported below it, and uses a steerable front ski. Both of these vehicles suffer from the requirement that a relatively great amount of propulsion power is required to drive them at planing speeds, and the load-lifting capacity of such vehicles is severely limited. Such vehicles, large and powerful enough to lift the weight of an average person, become so large, bulky, and heavy as to be relatively useless as recreational vehicles for one or two persons. In addition, although such vehicles can be managed during straight running by balancing the weight of the rider, turns are limited to relatively shallow ones because the increased load due to the high centrifugal forces of sharp turns cannot be supported by the skis. As a result, attempts to turn such vehicles sharply results in outward skidding of one or both skis, with the vehicle rolling inwardly until it falls. The ski arrangement of such vehicles makes sharply banked turns virtually impossible.

It has been a further disadvantage of prior art vehicles that they have not been able to negotiate rough water conditions in comfort and safety.

It is, therefore, desirable to produce a small, lightweight recreational water vehicle which is capable of supporting one or two people and which is capable of making sharp, high-speed banked turns without losing stability.

SUMMARY OF THE INVENTION

It is a principal object of the present invention to provide a water vehicle which may be enjoyed by one or two persons and which gives many of the same thrills as enjoyed by water skiers.

Another object of the present invention is to provide an aquatic vehicle for one or two riders which has some of the balancing characteristics of a two-wheeled land vehicle while in motion.

A further object of the present invention is to provide a vehicle which is easy and safe to ride and which utilizes a readily available conventional or modified outboard motor as a source of propulsion.

Another object of the present invention is to provide a small, inexpensive aquatic vehicle which is stable in high-speed banked turns, which can negotiate rough water in comfort and safety, and which can stand momentary immersion in the water without becoming inoperable.

A further object of the present invention is to provide an aquatic vehicle with an improved lifting mechanism to support the increased loads of high-speed turns.

Further objects are to provide a construction of maximum simplicity, efficiency, economy, and ease of assembly and operation.

Other objects and advantages of the present invention will become manifest upon a review of the following description and the accompanying drawings.

In one embodiment of the present invention there is provided an aquatic vehicle having a body with a seat for a rider, a steerable front ski secured to and adapted to support the forward end of the body in motion, and a lifting surface formed integrally with the lower surface of the body adapted to support the rear end of the body in motion, the lifting surface having a first part which is primarily effective to support the body when it is substantially unbanked and a second part adapted to provide additional support for the body when it is banked in a turn, whereby high-speed sharp turns may be executed by steeply banking the vehicle during such turns.

BRIEF DESCRIPTION OF THE DRAWINGS

Reference will now be made to the accompanying drawings, in which:

FIG. 13 is a perspective view of an alternate embodiment of a tunnel surface for the vehicle, omitting the rear wings;

FIG. 14 is a side elevational view of an alternate embodiment of a front ski;

FIG. 15 is a front end view of the front ski of FIG. 14;

FIG. 16 is a side elevational view of another embodiment of a front ski;

FIG. 17 is a vertical cross sectional view taken through the section 17—17 of FIG. 16;

FIG. 18 is an enlarged partial side elevational view showing an alternate propeller housing embodiment;

FIG. 19 is a horizontal cross sectional view taken through the section 19—19 of FIG. 18;

FIG. 20 is a partial vertical cross sectional view taken through the section 20—20 of FIG. 19;

DESCRIPTION OF THE PREFERRED EMBODIMENTS

Figure 1:
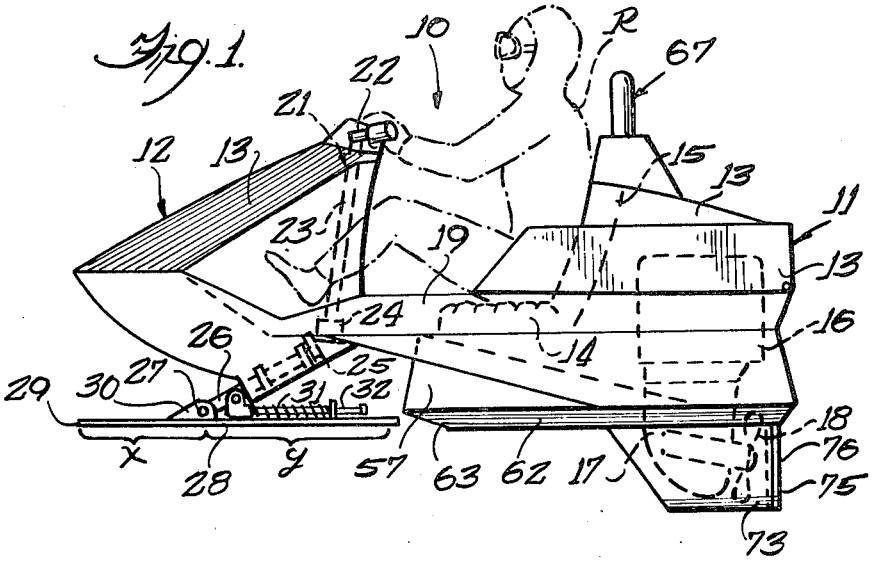
FIG. 1 is a side elevational view of an aquatic vehicle incorporating an illustrative embodiment of the present invention.
Figure 2:
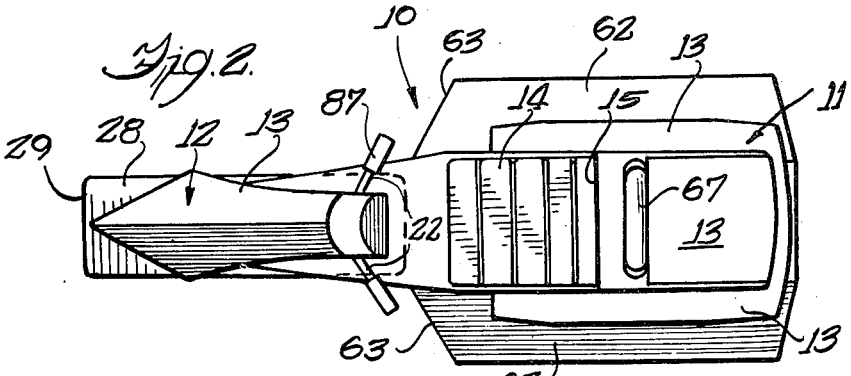
FIG. 2 is a plan view of the aquatic vehicle of FIG. 1.

FIG. 1 shows an aquatic vehicle 10 of the rider-balancing type having a body 11 with a forward nose portion 12 formed of a metal or fiberglass housing filled internally with suitable floatation material 13, such as a foam plastic. The body 11 is relatively narrow and includes a seat 14 supported on a horizontal platform 19 and a back rest 15 for the rider R and houses a conventional outboard motor 16 having a depending drive shaft 17 for a propeller 18.

Figure 8:
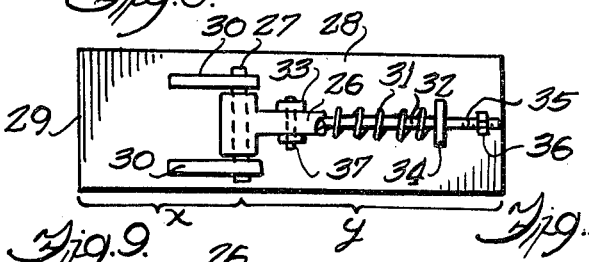
FIG. 8 is a plan view of the front ski of FIG. 6 as seen from the section 8—8 of FIG. 6.

The nose portion 12 of the body 11 houses the steering assembly 21 for the vehicle. The steering assembly includes a handlebar or handlegrip 22 secured to the upper end of a slightly inclined steering column 23 terminating at the lower end in a bevel gear 24. A second bevel gear 25 meshing with the gear 24 is secured to the upper end of a steering shaft 26 terminating in a T-shaped end carrying a transverse horizontal pivot 27 for the front ski 28. A pair of spaced flanges 30 is secured to the upper surface of the front ski, and the flanges 30 have openings to receive the ends of the pivot 27, which extends through the T-shaped end of the shaft 26 (FIG. 8).

The flanges 30 are so positioned on the ski relative to the longitudinal dimension thereof that the area x of the ski ahead of the pivot 27 acted upon by the water is less than the area y of the ski to the rear of the pivot 27, so that the force on the rear of the ski is greater than that of the forward end 29 of the ski. Thus, upon movement of the vehicle, the water acts on the rear area to tend to move the ski to a nearly horizontal planing position.

The ski 28 is maintained in an angularly inclined position while the speed of the vehicle is low, which provides greater lift in order to raise and maintain the ski 28 on the top of the water in a planing position as the speed of the vehicle is increased. This is accomplished by a compression spring 31, which surrounds a shaft 32 supported generally parallel to the upper ski surface by an enlarged angularly arranged bifurcated head 33, pivotally mounted on the shaft 26 by a pin 37, and a rearwardly positioned abutment 34 secured on the upper surface of the ski 28 and having an opening receiving the free end 35 of the shaft (FIGS. 6–9). A nut 36 threaded onto the free end 35 of the shaft 32 beyond the abutment 34 maintains the shaft 35 in assembled condition relative to the abutment 34.

When the vehicle 10 is stationary, the spring 31, acting between the head 33 and the abutment 34, causes the ski to rotate about the pivot 27 towards an angularly inclined position (FIG. 7), with the head 33 rotating about the pin 37. When the vehicle is started in motion by the motor 14, the water acting on the ski provides lift for the vehicle, and once the vehicle approaches planing speed, the force acting on the area y causes the ski to rotate towards a more nearly horizontal position, thus compressing the spring 31 by movement of the abutment 34 along the shaft 32. By proper selection of the areas x and y and the force of the spring 32, a predetermined maximum lift of 2 or 3 g's can be designed in the front ski. This reduces pounding motions in rough waters and gives a smooth movement through the water, with the ski 28 ploughing through the peaks of waves, rather than following the wave surfaces. In addition, when a banked turn is executed, the spring 31 urges the tail of the ski 28 downwardly and outwardly, so as to give a continuous lifting and turning action and to prevent plunging.

FIGS. 14–17 disclose alternative arrangements of the front ski which are also effective for steering the vehicle 10. The ski 38, shown in FIGS. 14 and 15, has a flat longitudinally extending central portion 39 carrying the pivot flanges 30 with downwardly inclined longitudinal fins 41 having rearwardly diverging or swept back front edges 42. This ski is provided with a spring assembly identical to that shown in FIGS. 6–8. The ski 43, shown in FIGS. 16 and 17, also has a central flat portion 44 carrying the pivot flanges 30 and downwardly inclined fins 45 having rearwardly diverging or swept back front edges 46. This ski embodiment is formed of two parts, each having a downturned central edge 47 perpendicular to the flat portion 44. The central edges 47 are suitably secured together to form a central depending rudder 48 to aid in steering the vehicle. This embodiment also has an identical spring assembly. In the arrangement of FIG. 17, the fins 45 may both be horizontal if desired, instead of downwardly inclined, as shown.

Figure 9:
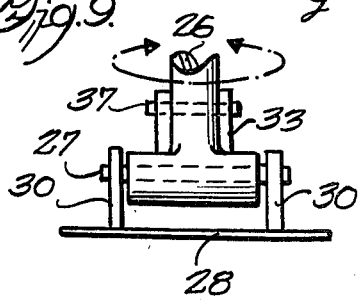
FIG. 9 is a front end view of the front ski of FIG. 6.
Figure 10:
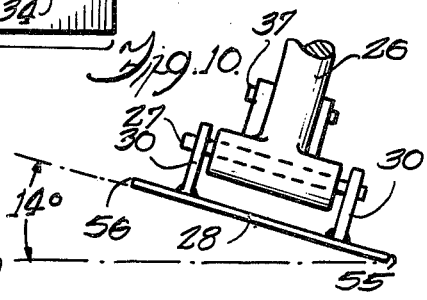
FIG. 10 is a front end view of the front ski of FIG. 6 when rotated for a turn.

The operation of the front ski 28 is illustrated in FIGS. 9 and 10. The steering shaft 26 is oriented at an angle in the range of 40° to 75° from the vertical, and preferably in the range of 50° to 65° from the vertical. Because of this angle, rotation of the shaft 26 not only turns the ski but also tilts the ski as shown in FIG. 10 toward the direction of turn. The tilt of the ski blade on turning causes the right edge 55 (FIG. 10) to dip or dig into the water while the left edge 56 is lifted partially out of the water. Turning the ski in the opposite direction causes an opposite tilt. This assists in turning the vehicle, by reducing the skidding tendency of the front ski, and increasing the action of the front ski in carving a tight turn through the water.

Figure 11:
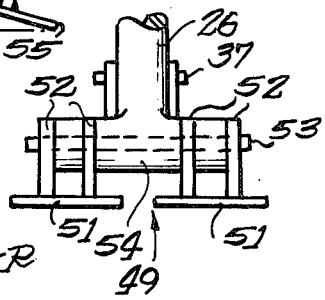
FIG. 11 is a front end view of a modified front ski.

An alternative front ski arrangement 49 is shown in FIG. 11. A pair of parallel skis 51 each have a pair of bearing flanges 52 receiving a pivot 53 of a T-shaped head 54 which forms the lower end of the shaft 26. The two skis may be either independent, as shown, or connected together for simultaneous movement. In either case, a spring assembly similar to the assembly including the spring 31 is employed to bias the skis toward an inclined position.

The pivot 27, located as shown, allows the front edge 29 of the ski 28 to move upward as the shaft 26 rotates, so that a planing action is maintained when the ski is turned. Thus, in any turn, any forward slippage is converted to lift, and any tendency of the ski to dive into the water is avoided.

Figure 4:
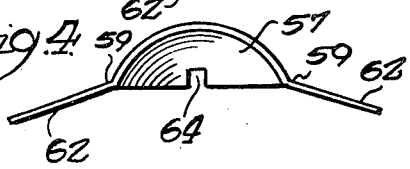
FIG. 4 is a front end view of a tunnel and rear wings forming the rear lifting surface of the vehicle of FIG. 1.
Figure 5:
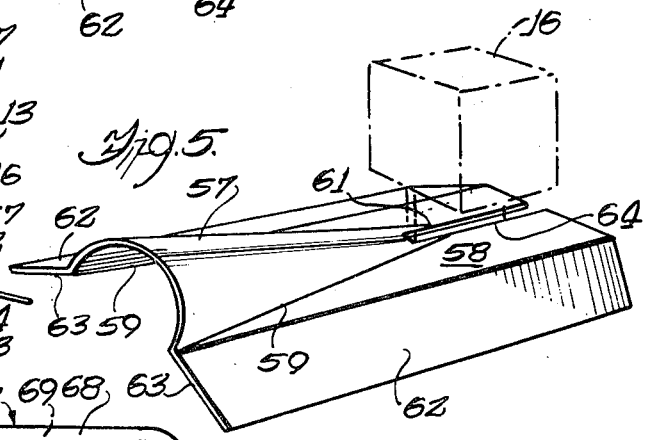
FIG. 5 is a perspective view of the tunnel and wings of FIG. 4.
Figure 12:
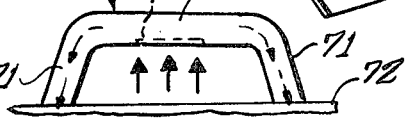
FIG. 12 is a rear elevational view of the air intake for the motor of the vehicle of FIG. 1.
Figure 6:
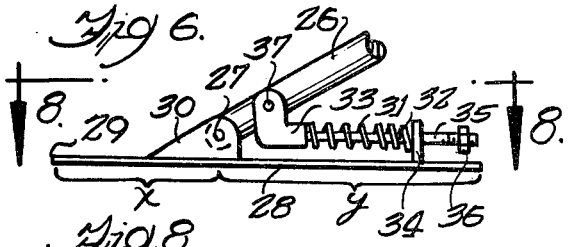
FIG. 6 is an enlarged side elevational view of the front ski of the vehicle of FIG. 1, shown in planing position.
Figure 7:
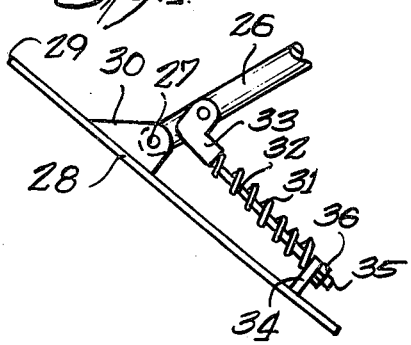
FIG. 7 is an enlarged side elevational view of the front ski of FIG. 6 in inclined starting position.

A tunnel surface 57 forms the undersurface of the vehicle body 11, as best shown in FIGS. 4 and 5. The tunnel 57 is formed integrally with the body 11, as the latter is molded of fiberglass or the like. Alternatively, the tunnel surface may be formed of sheet metal and secured to the bottom of the body 11, and any space between the upper surface of the sheet metal and the bottom of the body 11 is filled in so that the effect is the same as if the tunnel were formed integrally with the body. The tunnel surface 57 comprises a generally conical surface having a semi-circular forward edge 55, with side edges 59 converging and tapering toward the rear of the vehicle and terminating at the end 61. A flat surface 58 intersects with the tunnel surface 57 along the lines 59. A pair of rear wings 62 extend outwardly and downwardly from the side edges of the surface 58. The surface 58 is slotted at 64 or has another suitable opening to receive the propeller shaft 17 or the lower portion of the motor 16. Various alternate tunnel designs may be used with various efficiencies if three requirements are observed: the tunnel must have a relatively smooth top surface for efficient swirling and reactive action of the water; it must be inclined relative to the direction of movement so as to form a lifting surface having an angle of attack; and the relative proportions of the entire unit must be such that a lifting force is produced by the tunnel during banked turns.

The rear wings 62 may be horizontal extensions of the flat plate 58 or downwardly angled, as shown in FIG. 4. The wings 62 function as lifting surfaces for lifting the vehicle during movement in the water. The tunnel 57 also acts as a lifting device at relatively low speeds and during banked turns. The tunnel also functions to funnel water toward the propeller, for more efficient propeller action. The downward angle of the wings 62 is selected to give the desired amount of anti-roll movement so that an unstable condition does not occur during banking, but the rider is free to bank as steeply as desired by leaning to one side.

On banked turns, action of the water flowing against the tunnel surface 57 provides an inward (centipetal) force, which helps to resist further rolling or skidding of the vehicle during turning. The action of the tunnel appears to be that of a highly cambered lifting surface, when the direction of water flow is not parallel with the center line of the tunnel. As seen by a flow in an off axis direction, the shape of the tunnel camber is hyperbolic (when the tunnel is conical) or parabolic, which are very efficient shapes for converting a flow of water into a force acting on the surface. When the vehicle is executing steeply banked turns, with the angle of bank approximately 45°, the outboard (toward the outside of the turning circle) rear wing is raised by banking the vehicle until it is nearly entirely out of the water, and the inboard rear wing is lowered. The relative direction of water flow past the inboard wing is believed to change so as to reduce the lift acting on the inboard wing. Thus a banked attitude can be maintained without being overcompensated by hydraulic forces. At the same time, the banking causes the inboard side of the tunnel to become submerged in the water, with the outboard side of the tunnel skimming along the water surface, and the leading edge of the outboard side of the tunnel surface is actually out of the water, along with the leading edge of the outboard rear wing. The tunnel surface is available to give increased lift to reduce the tendency of the rear end of the vehicle to ride lower in the water during a turn. In a banked turn, the water flow is directed toward the tunnel surface from the inboard side, and this flow is deflected by the tunnel surface to give significant lift to the vehicle.

The shape of the tunnel surface 57, although illustrated as conical in FIGS. 4 and 5, may instead by any smooth, curved surface which presents a highly cambered surface to off axis water flow, to give increased lift during a turn. The tunnel surface must also have some side wall area on the inboard side which intercepts a portion of the water flow during banked turns to generate a force directed inwardly of the turn.

An alternative arrangement is shown in FIG. 13, including a flat plate 65 and a tapering tunnel surface 66. This arrangement can be utilized with the vehicle of FIG. 1 if the power of the motor is increased so that the decreased area of the plate 65, in relation to the rear wings 62 of FIG. 5, is effective to supply the required lifting force. The tunnel shown in this figure is in the form of a truncated conical surface having an apex beyond the rear edge of the plate 65.

An inverted U-shaped air intake 67 (FIGS. 1, 2, 3, and 12) comprises a hollow tube having a horizontal portion 68, with a downwardly opening central air intake slot or aperture 69, and downturned ends 71 communicating in water-tight relationship through suitable openings in the top 72 of the body 11. The intake tube 67 is positioned well behind the position of the back of a rider R, to provide an unimpeded source of air for operation of the motor when the vehicle is at rear and when it is moving at high speed.

Figure 3:
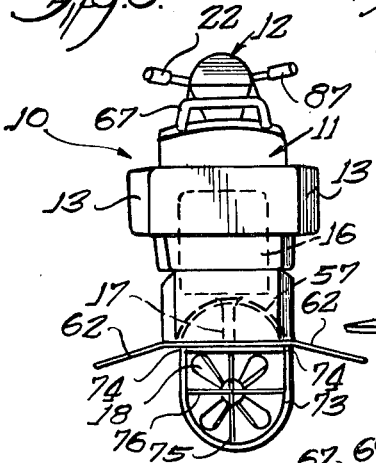
FIG. 3 is a rear elevational view of the vehicle of FIG. 1.

A propeller 18 is connected to the drive arrangement 17 which extends below the body 11, and a generally circular cowling 73 is secured to the bottom of the body 11, at the surface 58. The cowling 73 acts to increase the efficiency of the propeller and also serves as a mounting for a pair of anti-torque blades 75 and 76 (FIG. 3). The anti-torque blade 75 is oriented vertically and the blade 76 is oriented horizontally, and both are supported by the cowling 73, as best shown in FIGS. 18–20. They function to remove the twisting and swirling action of the water resulting from the rotation of the propeller 18.

The horizontal blade 76 is horizontally pivoted on oppositely extending pivot pins 77 projecting through aligned openings in the sides of the cowling 73. A central reduced section 79, defined by slots 81 extending inwardly from front and rear, projects through a suitable opening (not shown) in the vertical blade 75. The rear end 82 of the blade 76 projects beyond the rear edge 83 of the cowling 73, and the outer edges 84 diverge rearwardly in swept back fashion. Two pairs of spaced stops 85 and 86 are secured to the rear edge 83 of the cowling 73, the upper pair of stops 86 maintaining the blade 76 in a generally horizontal position, as shown in FIG. 18, while the lower stops 85 limit downward movement of the rear end of the blade. The downwardly angled blade 76 provides increased lift as the vehicle 10 speeds up from a stationary position. When increased speed is achieved, the blade 76 is rotated, by the water flow, to the horizontal position shown in FIG. 18, which is more efficient for high speed operation.

Figure 24:
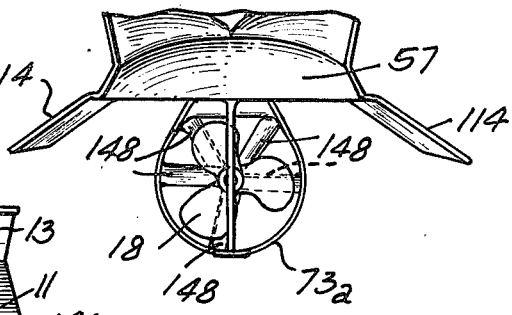
FIG. 24 is an end elevational view of the rear lifting surface employed in the apparatus of FIG. 23.

An alternative arrangement of the cowling 73, shown in FIG. 24, incorporates a plurality of fixed anti-torque blades 148, disposed in spaced spoke-like relationship about the cowling 73. Each of the blades 148 is cambered slightly, about 5%, and is slightly inclined relative to the axis of the propeller 18 (i.e. the pitch angle), to supply a torque to the cowling 73 which is equal and opposite to the torque effect of the propeller 18 rotating in water. The precise angle of inclination required to exactly cancel the torque effect is dependent upon the speed of the flow, and any angle which is correct for one speed is not precisely correct for other speeds. Preferably, the pitch angle is selected to be correct for a moderate speed, at which other hydrodynamic forces, which tend to stabilize against the torque of the propeller, are not as great, and cancelling the propeller torque becomes more critical. With such a pitch angle selected, some torque correction is available at lower speeds also, so that it is easy for a rider to achieve stable operation of the vehicle by balancing.

The cowling 73 is formed generally in the shape of a tube, aligned with the axis of the propeller 18, and this axis is preferably inclined upwardly from the horizontal approximately 9°. Thus, some lift of the vehicle is achieved by virtue of the slightly downwardly directed stream of water issuing from the propeller 18.

When the vehicle is stationary in the water, the seat 14 is slightly below the water surface, and the floatation material 13 secured to the upper portion of the body 11 keeps the vehicle upright. The front ski 28 and the horizontal anti-torque blade 76, if utilized, are both forwardly and upwardly inclined for greater lift. The rider R controls the motor 16 by a conventional twist-grip 87 on the handlebar 22 to initiate movement of the vehicle. Initial movement results in a high lifting force created by the angular position of the front ski 28, the horizontal blade 76, the configuration of the tunnel surface 57 and the rear wings 62, and the inclination of the propeller 18 and cowling 73.

The lifting force causes upward as well as forward movement of the vehicle until the vehicle reaches its planing position. As the speed of the vehicle increases, the front ski 28 rotates against the force of the spring 31, and the blade 76 rotates toward a generally horizontal position. Once forward motion starts and the center of gravity rises above the center of buoyancy, the rider R must maintain balance of the vehicle in the same manner as a two-wheeled land vehicle or cycle.

In planing position, the front ski 28 and the rear wings 62 act as lifting surfaces. To turn the vehicle, the rider R shifts his balance by leaning, and simultaneously rotates the handlegrip 22 to direct the attitude of the front ski 28 to the right or the left. The vehicle is provided with a safety switch on the twist-grip 87 controlling the motor 16 such that if the rider falls off of the vehicle or otherwise releases the twist-grip 87, the motor will automatically stop.

Although the propulsion unit for the vehicle 10 is shown and described as a conventional outboard motor 16 and a propeller 18, it is apparent that any other conventional propulsion means could be used, such as a water jet or the like. It does appear essential to operation of the present invention, however, that the propulsion force act at the rear end of the unit, and that it be directed in nonrotatable fashion backward along the center line of the vehicle.

Figure 21:
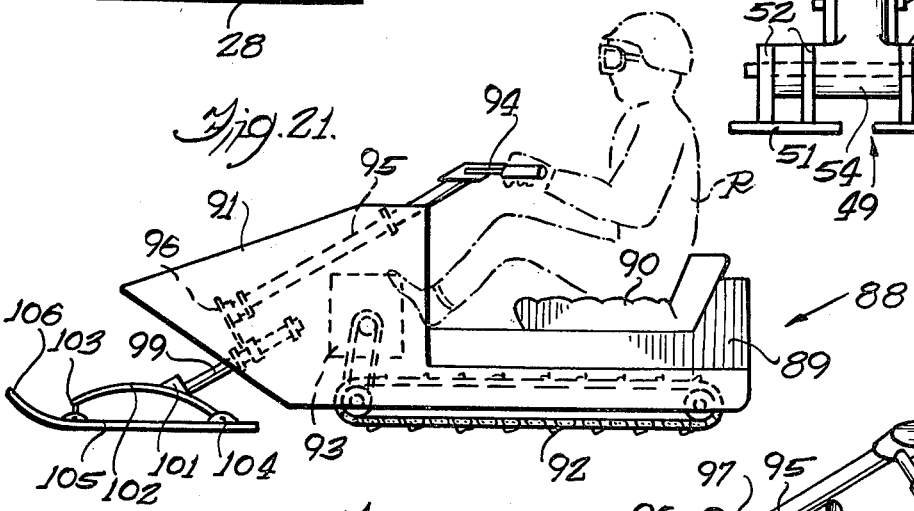
FIG. 21 is a side elevational view of a snowmobile incorporating another embodiment of the present invention.
Figure 22:
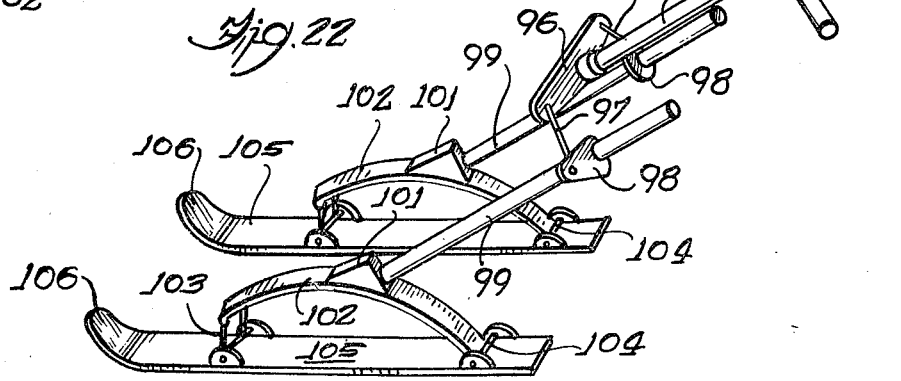
FIG. 22 is a perspective view of the steering mechanism for the front snow skis of FIG. 21.

A conventional snowmobile 88 is shown in FIGS. 21 and 22 in which the novel steering arrangement of the present invention is employed. The snowmobile includes a body portion 89 carrying a seat 90 for the rider R and a front hood portion 91. An endless track 92 is mounted on sprockets or other rotating members driven by a suitable motor 93, in the conventional manner. A handlegrip or handlebar 94 is rotatably mounted on the hood portion 91, and a shaft 95 is secured at an angle in the range of 40° to 75° from the vertical. The shaft 95 is attached at its upper end to the handlebar 94.

The central portion of an elongate plate 96 is secured to the lower end of the shaft 95, and a pair of links 97 are connected between the outer ends of the plate 96 and the free ends of cranks 98 secured to rotatable secondary shafts 99. The shafts 99 are also inclined at an angle in the range of 40° to 75° from the vertical, and their lower ends are secured to mounting members 101, mounted on bowed leaf springs 102. Each leaf spring 102 is connected by a forward link 103 and a rearward pin 104 to a flat ski 105 with an upturned front end 106. The forward upturned ends are necessary when the skis are riding on snow and/or ice rather than on water.

The angle which the parallel secondary shafts 99 makes with the vertical is in the range of 40° to 75°, and preferably in the range of 50° to 65°. Upon rotation of the shaft 95, the shafts 99 are simultaneously rotated to turn the skis 105. Due to the angle of the shafts 99, the skis are also tilted in the direction of turn with their inner edges digging into the snow. This steering of the snowmobile is enhanced and made more effective, efficient, and safe because small protrusions in the ground slide under the outer edge rather than snagging and turning the vehicle out of control.

Figure 25:
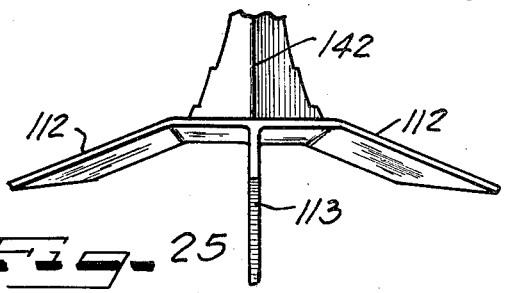
FIG. 25 is an end elevational view of the front ski employed in the apparatus of FIG. 23.

Referring to FIGS. 23–27, an alternative arrangement of an aquatic vehicle is illustrated. The front ski 112 differs from the other front skis described above. It is similar in its mounting arrangement, including the spring 31 and the retaining shaft 32, but the shape of the ski is modified to provide a wider, shorter area, improving the aspect ratio, which is the width-to-length ratio. Increasing this ratio increases the amount of lift per unit area of the lifting surface, so that the area may be made smaller without unduly sacrificing lift, bringing about a marked improvement in drag through lowered resistance to the ski moving through the water. A centrally located depending keel 113 is provided to assist in turning the vehicle and to provide some lift for the front end of the vehicle during banked turns. In addition, the front edges of the ski 112 are swept back like a cow catcher to assist in shedding any debris which may be encountered in the water. In the arrangement of FIG. 25, the steering shaft 26 is enclosed in a downwardly extending part of the forward portion 12 of the body.

The rear wings 114 have also been modified, by having a major portion of the front end of the wing removed and the leading edge of the remainder swept back at a sharp angle. Shortening the length of the rear wings improves the aspect ratio of the wings and increases their efficiency in the same way that this step increases the efficiency of the modified front ski, as described above. The reduction in wing area is accompanied by only a slight loss in lift, which is approximately balanced by the reduced weight of the shorter wings. In addition, the resistance to movement through the water is reduced, and so the speed is increased at the same level of propulsion power. The reduced weight also makes the vehicle more easily handled by one or two persons during launching and other out-of-water handling operations.

Figure 26:
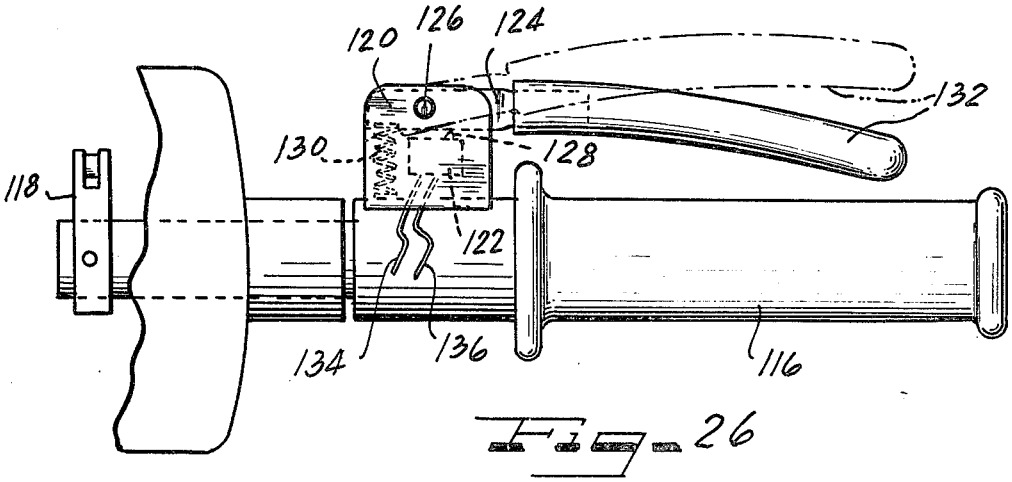
FIG. 26 is an elevational view of a portion of one of the handlebars of a vehicle incorporating another embodiment of the present invention and showing details of the safety switch.

FIG. 26 shows a detail of one of the handlebars of the vehicle, with its safety switch. The handlegrip 116 is of the conventional sort generally used with motorcycles or the like, in which rotation of the grip opens and closes the motor throttle. This is accomplished through a crank 118 connected to the throttle linkage (by means not shown) which is rotated with the handlegrip 116.

Secured to the inner end of the handlegrip 116 is a housing 120 which contains a miniature switch 122. A lever 124 is pivotally mounted on the housing by a pin 126 and bears against the actuator 128 of the switch 122. A compression spring 130, supported in the housing 120, bears against the inner end of the lever 124 and urges it outwardly relative to the handlegrip 116, rotating it in a clockwise direction against the actuator 128. The lever 124 is received in one end of a short length of rubber tubing 132, and is urged by the lever 124 against the handlegrip 116. When the actuator 128 of the switch 122 is depressed, the switch opens a connection between two wires 134 and 136 connected to the terminals of the switch. The wires 134 and 136 are connected in circuit with the ignition system of the motor, and so the motor is disabled while the actuator 128 is depressed.

As a rider grips the handlegrip 116, his fingers enter the space between the handlegrip 116 and the tubing 132, forcing the latter away from the handlegrip 116 and disengaging the lever 124 from the actuator 128. This closes the electrical connection between the wires 134 and 136 and enables the motor to run in its normal manner.

The described safety switch arrangement constitutes an improvement over other known safety switch arrangements in that no finger or thumb pressure is required by the operator to keep the motor running, but the motor stops instantly when the hand is removed from the handlegrip 116, and any force which tends to urge the tubing 132 against the handlegrip 116 during a fall, or otherwise, cannot cause the motor to continue running. It will be appreciated by those skilled in the art that this safety switch design is also useful for snowmobiles and the like. No extra motion is required of the rider in using the safety swich, because the hand of the rider must always remain on the handlegrip 116 to control the throttle of the motor.

An important feature of the present invention is its hydrodynamic characteristics, which enable a rider to achieve stability by balancing, while waves and cross currents have very little adverse affect on stability. Thus, the rider can easily initiate a roll of the vehicle by leaning. As the angle of roll increases, however, forces are brought into play which partially resist the tendency to roll further, and make it easy for the operator to control the amount of roll, for banking of shallow turns or highly banked steep turns, as desired. Rolling of the vehicle to any angle of roll at which the top portion of the vehicle body 11 remains out of the water never produces a condition where the vehicle cannot be righted by shifting the balance of the rider and by adjusting the steering. This feature enables the vehicle of the present invention to be employed in the execution of high speed turns, which are highly banked to balance the centrifugal force of the turn. Of course, if the bank is so steep that the upper portion of the body 11 drags in the water, drag forces are produced which usually result in the vehicle's heeling over excessively until its speed is reduced and it can right itself by the buoyancy of the floatation material. After a short period of practice, a rider can easily learn to avoid this condition. The vehicle does not become inoperative, even if completely immersed for short periods.

The forces which resist the uncontrolled rolling of the vehicle during steeply banked turns are centrifugal force, resulting from the turn itself, the increased lift, and the force of the water flow against the tunnel surface 57, which has a substantial inward radial component. All of these forces tend to resist uncontrolled rolling of the vehicle and outward skidding of the vehicle during steeply banked turns.

The tunnel surface functions to produce an anti-roll and anti-skid force. The inboard side of the tunnel is deeper in the water than the outboard side, which may be partially out of the water. In addition, the surface of the inboard side of the tunnel surface is nearly vertical during a steeply banked turn and resists skidding outwardly. Moreover, if any such skidding does occur, the skidding-flow, acting against the inboard side of the tunnel surface, gives rise to additional anti-roll forces and to additional lifting forces, which tend to resist further roll and to stabilize the vehicle.

As a result of the several forces which are effective during banked turns, stable banked turns are possible using much steeper banking angles than would be possible without the tunnel surface of the present invention, which provides effective traction between the vehicle and the water surface.

Figure 23:
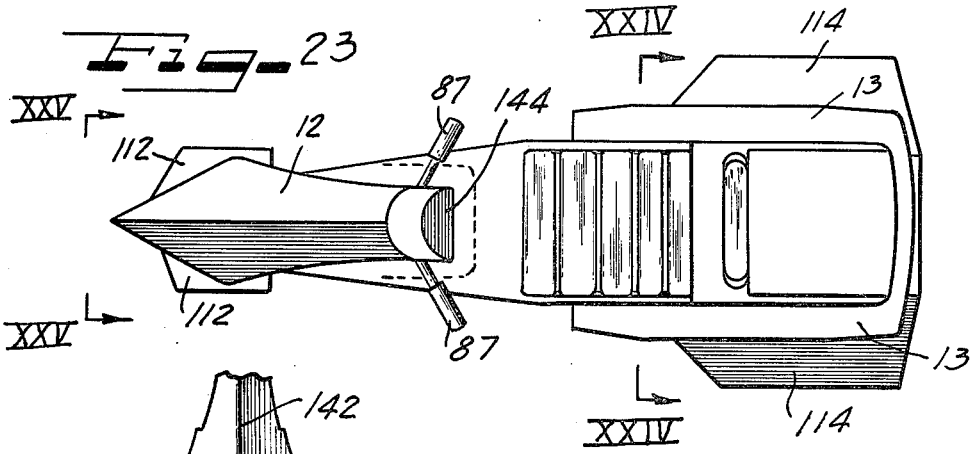
FIG. 23 is a plan view of a modified embodiment of the present invention.
Figure 27:
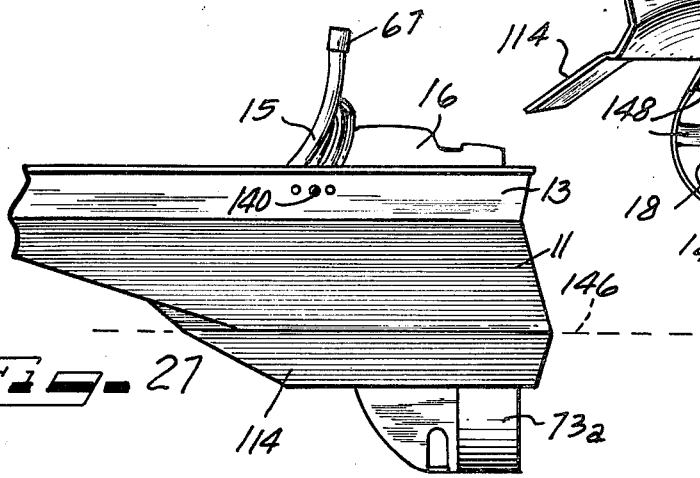
FIG. 27 is a side elevational view of the rear portion of the apparatus of FIG. 23.

FIGS. 24 and 27 show end and side views of the rear end of the arrangement of FIG. 23. FIG. 27 shows the rear end of the vehicle with the cover removed from over the motor compartment, so that the upper portion of the motor 16 is visible. An exit port 140 is provided in the side of the body 11, and the outlet of a pump (not shown) is connected to the port 140. The pump may either run continuously, driven by an electric motor powered by a battery (not shown), or it may be controlled by a float control valve (not shown), arranged to energize the pump motor whenever water enters the motor compartment. The inlet of the pump is preferably located near the bottom of the motor compartment. Suitable pump and electric starter arrangements are well known to those skilled in th art and are therefore not described specifically herein.

The motor 16 is provided with an electric starter (not shown), so the motor can be started conveniently and easily when the vehicle is first put into the water and whenever the motor stops as a result of releasing the handlegrip 116 (FIG. 26). The starter switch and other necessary control switches are conveniently mounted on a panel 144 between the handlegrips 87.

The cowling 73*a* is illustrated in FIGS. 24 and 26, and is tilted upwardly about 9° relative to the water surface, indicated in FIG. 27 by the dashed line 146. Five anti-torque blades 148 are mounted inside the cowling 73, and each of the blades is cambered slightly so as to impart a torque to the cowling 73 which resists the torque caused by rotation of the propeller 18.

The rear wings 114 may, instead of being planar, as illustrated, be provided with a convex upper surface, in the nature of a hydrofoil. This appreciably increases the amount of lift realizable from the rear wings. Such hydrofoil shapes are well known.

In the foregoing, the present invention has been described in sufficient particularity as to enable others skilled in the art to make and use the same. It will be apparent that various modifications and changes may be made without departing from the essential features of novelty of my invention, which are intended to be defined and secured by the appended claims.

What is claimed is:

1. An aquatic vehicle comprising a narrow vehicle body having floatation material secured thereto, steering means at the forward end of the body including a steering column and a steering shaft operatively connected to said steering column and projecting forwardly and downwardly of the vehicle body at an angle in the range of 40° to 75° from the vertical, a front ski member, a generally horizontal transverse pivot connecting the front ski member to the steering shaft at a point fowardly of the center of torque of the ski member, compression spring means on the front ski member and operatively connected to said steering shaft to yieldably bias the ski member to rotate towards an upwardly and forwardly inclined position, a flat plate defining the undersurface of the vehicle body, a rearwardly and downwardly inclined tapering tunnel formed in said plate longitudinally aligned with the front ski member and opening in a generally semi-circle at the forward edge of the plate spaced rearwardly of the front ski member and terminating adjacent the rear edge of the plate, a pair of outwardly extending and downwardly inclined longitudinal fins integral with said flat plate along the sides of the body and below the tunnel surface, a motor located in the body adjacent the rear end thereof, a depending drive shaft terminating in a propeller, anti-torque means cooperating with the propeller including a cowling encompassing the propeller and a pair of blades intersecting at right angles supported by the cowling behind the propeller, and a hollow air intake in the body communicating between the exterior of the body and the motor.

2. An aquatic vehicle comprising a narrow vehicle body having floatation material secured thereto, steering means at the foward end of the body, a front ski member, a generally horizontal transverse pivot for said front ski member forming an operative connection to said steering means, a rearwardly and downwardly inclined tapering tunnel formed in the undersurface of the vehicle body to terminate adjacent the rear edge thereof, said tunnel being longitudinally aligned with and spaced rearwardly of the front ski member, and propulsion means located adjacent the rear edge of the vehicle body to propel the vehicle and rider through the water, wherein said tunnel opens in a semi-circle at the forward edge thereof and is formed in a generally flat plate defining the lower surface of the vehicle body, the tunnel terminating short of the rear edge of the plate, and including a pair of outwardly extending longitudinal fins along the sides of and below the tunnel surface, said fins being integral with said flat plate.

3. An aquatic vehicle comprising a narrow vehicle body having floatation material secured thereto, steering means at the forward end of the body, a front ski member, a generally horizontal transverse pivot for said front ski member forming an operative connection to said steering means, a rearwardly and downwardly inclined tapering tunnel formed in the undersurface of the vehicle body to terminate adjacent the rear edge thereof, said tunnel being longitudinally aligned with and spaced rearwardly of the front ski member, and propulsion means located adjacent the rear edge of the vehicle body to propel the vehicle and rider through the water, wherein said tunnel opens in a semi-circle at the forward edge thereof and is formed in a generally flat plate defining the lower surface of the vehicle body, the tunnel terminating short of the rear edge of the plate, and including a pair of outwardly extending and downwardly inclined longitudinal fins integral with said flat plate along the sides of the body and below the tunnel surface.

4. An aquatic vehicle adapted for powered movement through water comprising a narrow body, steering means connected to said body located at the forward end of said body along the center line of said body, the lower surface of said body comprising a concave supporting surface located behind said steering means along the center line of said body, said supporting surface sloping downwardly and rearwardly relative to the direction of said movement, and propulsion means mounted in said body and adapted to propel said body through the water, said body including a seat located between said steering means and said supporting surface, a quantity of floatation material disposed at the upper portion of said body and having a buoyancy sufficient to maintain said vehicle in floating condition in the water when a driver is not in position on the vehicle, but insufficient to maintain said seat above the waterline when the vehicle is stationary in the water, with a driver in said seat.

5. Apparatus according to claim 4, wherein said steering means comprises a front ski member located at the extreme forward end of said vehicle, and including means for turning said ski relative to the direction of travel of said vehicle, steering of said vehicle being performed by simultaneously turning said ski and said driver leaning to one side.

6. Apparatus according to claim 5, including a planar keel connected to the bottom of said front ski member and extending downwardly therefrom, said keel defining a plane intersecting a line parallel to the direction of travel of said vehicle when said front ski member is rotated during turning of said vehicle.

7. Apparatus according to claim 4, wherein said steering means and said supporting surface each comprise lifting surfaces for producing an upwardly directed force when said vehicle is in motion through the water, whereby the elevation of said vehicle is raised substantially in relation to the water level when in motion.

8. An aquatic vehicle comprising a narrow vehicle body including a centrally disposed seat for a driver, propulsion means for propelling the vehicle through the water, and lifting means disposed along the center line of said body for raising the position of said vehicle in the water as it is propelled forward, said lifting means including a concave lifting surface formed in the lower surface of said body, said lifting means being effective to lift the center of gravity of said vehicle above the center of buoyancy, whereby said vehicle may be maintained in upright position while being propelled through the water by balancing of the driver, said lifting means comprising a tunnel surface formed as a part of the lower surface of said body, said tunnel surface opening in concave downward fashion with the side walls of said tunnel surface, at their outer edges, angled downwardly and outwardly, the intersection of said tunnel surface with a vertical plane passing through the center line of said vehicle comprising a rearwardly and downwardly sloping line.

9. An aquatic vehicle comprising a narrow vehicle body including a centrally disposed seat for a driver, propulsion means for propelling the vehicle through the water, and lifting means disposed along the center line of said body for raising the position of said vehicle in the water as it is propelled forward, said lifting means including a concave lifting surface formed in the lower surface of said body, said lifting means being effective to lift the center of gravity of said vehicle above the center of buoyancy, whereby said vehicle may be maintained in upright position while being propelled through the water by balancing of the driver, said lifting means including a pair of generally planar wings, said wings extending outwardly and downwardly from the rear portion on each side of said body, said wings being effective to produce a lifting force as said vehicle moves through the water without any substantial roll stability while said vehicle is upright, whereby roll stability must be achieved by the shifting of weight by the rider of the vehicle.

10. An aquatic vehicle comprising a narrow vehicle body including a centrally disposed seat for a driver, propulsion means for propelling the vehicle through the water, and lifting means disposed along the center line of said body for raising the position of said vehicle in the water as it is propelled forward, said lifting means including a concave lifting surface formed in the lower surface of said body, said lifting means being effective to lift the center of gravity of said vehicle above the center of buoyancy, whereby said vehicle may be maintained in upright position while being propelled through the water by balancing of the driver, said lifting means including a pair of generally planar wings, said wings extending outwardly from the rear portion on each side of said body, each of said wings having a swept back leading edge, said wings being effective to produce a lifting force as said vehicle moves through the water without any substantial roll stability while said vehicle is upright, whereby roll stability must be achieved by the shifting of weight by the rider of the vehicle.

11. An aquatic vehicle comprising a narrow vehicle body including a centrally disposed seat for a driver, propulsion means for propelling the vehicle through the water, and lifting means disposed along the center line of said body for raising the position of said vehicle in the water as it is propelled forward, said lifting means including a concave lifting surface formed in the lower surface of said body, said lifting means being effective to lift the center of gravity of said vehicle above the center of buoyancy, whereby said vehicle may be maintained in upright position while being propelled through the water by balancing of the driver, said lifting means including a pair of generally planar wings, said wings extending outwardly from the rear portion on each side of said body, each of said wings having a convex upper surface, said wings being effective to produce a lifting force as said vehicle moves through the water without any substantial roll stability while said vehicle is upright, whereby roll stability must be achieved by the shifting of weight by the rider of the vehicle.

12. An aquatic vehicle comprising a narrow vehicle body, floatation material secured to said vehicle body, steering means located at the forward end of said body, a steerable front ski operatively connected to the steering means for supporting the forward portion of said body, a downwardly and rearwardly inclined tunnel formed in the undersurface of said vehicle body longitudinally aligned with and positioned rearwardly of said front ski, a motor in said body having a depending drive shaft connected with a propeller, and anti-torque means cooperating with said propeller.

13. An aquatic vehicle comprising a narrow vehicle body including a centrally disposed seat for a driver, propulsion means for propelling the vehicle through the water, and lifting means disposed along the center line of said body for raising the position of said vehicle in the water as it is propelled forward, said lifting means including a concave lifting surface formed in the lower surface of said body, said lifting means being effective to lift the center of gravity of said vehicle above the center of buoyancy, whereby said vehicle may be maintained in upright position while being propelled through the water by balancing of the driver, said lifting means including a pair of generally planar wings, said wings extending outwardly from the rear portion on each side of said body, said wings being effective to produce a lifting force as said vehicle moves through the water without any substantial roll stability while said vehicle is upright, whereby roll stability must be achieved by the shifting of weight by the rider of the vehicle, said lifting surface comprises a smoothly curved, downwardly opening funnel-like tunnel surface, with a forward location of said tunnel surface having a larger perimeter than a rearward location of said tunnel surface, the perimeter in each case being the length of the intersection formed by said tunnel surface in a plane normal to the center line of the vehicle, the upper portion of said tunnel surface being sloped downwardly and rearwardly to provide lift as said vehicle moves through the water.

14. Apparatus according to claim 13, including a steerable front ski for supporting the forward end of said body, such that at least the upper extremity of the forward end of said tunnel surface is above the water level when said vehicle is moving forward in an upright condition, a portion of the forward end of said tunnel surface passing below the water level during execution of a banked turn, to provide a force directed toward the inside of such turn which resists skidding of the vehicle outwardly and resists rolling of the vehicle inwardly.

15. An aquatic vehicle comprising a narrow vehicle body, flotation material secured to said vehicle body, steering means located at the forward end of said body, a steerable front ski operatively connected to the steering means for supporting the forward portion of said body, a rearwardly inclined tunnel formed in the undersurface of said vehicle body longitudinally aligned with and positioned rearwardly of said front ski, a motor in said body having a depending drive shaft connected with a propeller, and anti-torque means cooperating with said propeller, said tunnel opening in a semi-circle at the forward edge of said body and tapering rearwardly and downwardly toward said propeller.

16. An aquatic vehicle comprising a narrow vehicle body, flotation material secured to said vehicle body, steering means located at the forward end of said body, a steerable front ski operatively connected to the steering means for supporting the forward portion of said body, a rearwardly inclined tunnel formed in an undersurface of said vehicle body longitudinally aligned with and positioned rearwardly of said front ski, a motor in said body having a depending drive shaft connected with a propeller, anti-torque means cooperating with said propeller, and including a pair of outwardly extending longitudinal wings connected with the bottom surface of said body.

17. An aquatic vehicle comprising a relatively narrow body, a seat for a rider supported on said body, flotation means secured to said body and adapted to hold said body afloat when said body is in a stationary condition in the water, a steerable front ski secured to said body and adapted to support the forward portion of said body when said body is moving through the water, a manually operable steering member secured to said body and connected to said front ski, and a pair of wings extending laterally from the rear portion of said body for assisting in the support of the rear portion of said body during movement thereof through the water, said front ski and said rear wings exerting a lifting force on said body during such movement which is sufficient to raise said body so that said flotation material is out of contact with the water, the bottom surface of said body being formed with a concave downwardly sloping supporting surface, to assist in supporting the rear end of said body.

18. An aquatic vehicle comprising a narrow vehicle body including a centrally disposed seat for a driver, propulsion means for propelling the vehicle through the water, and lifting means disposed along the center line of said body for raising the position of said vehicle in the water as it is propelled forward, said lifting means including an inclined concave lifting surface formed in the lower surface of said body, said lifting means being effective to lift the center of gravity of said vehicle above the center of buoyancy, whereby said vehicle may be maintained in upright position while being propelled through the water by balancing of the driver, said lifting means also comprising a pair of generally planar wings, one of said wings extending outwardly from the rear portion on each side of said body, said wings being effective to produce a lifting force as said vehicle moves through the water without any substantial roll stability while said vehicle is upright, whereby roll stability must be achieved by the shifting of weight by the rider of the vehicle.

19. Apparatus according to claim 18, wherein said wings have an aspect ratio of approximately unity, said aspect ratio being the quotient of the span of said wings measured in a direction transverse to the center line of said vehicle, divided by the length of said wings measured in a direction parallel to said center line.

20. Apparatus according to claim 18, wherein said rear wings extend outwardly from the lower surface of said body.

21. Apparatus according to claim 20, wherein said propulsion means comprises a motor mounted within said body and a propeller mounted immediately below the lower surface of said body.

22. Apparatus according to claim 18, wherein said lifting means also includes a tunnel surface formed in the lower surface of said body, said tunnel surface being smoothly curved and concave opening downwardly.

23. Apparatus according to claim 22, wherein said tunnel surface is funnel-like, with a forward location of said tunnel having a larger perimeter than a rearward location of said tunnel, the perimeter in each case being the length of the intersection formed by said tunnel surface and a plane normal to the center line of the vehicle.

24. Apparatus according to claim 23, wherein said propulsion unit comprises a motor located in said body and a propeller disposed adjacent the rear end of said tunnel surface, whereby said tunnel operates to funnel water toward said propeller as said vehicle moves through the water.

25. An aquatic vehicle comprising a narrow vehicle body including a centrally disposed seat for a driver, propulsion means for propelling the vehicle through the water, and lifting means disposed along the center line of said body for raising the position of said vehicle in the water as it is propelled forward, said lifting means including an inclined concave lifting surface formed in the lower surface of said body, said lifting means being effective to lift the center of gravity of said vehicle above the center of buoyancy, whereby said vehicle may be maintained in upright position while being propelled through the water by balancing of the driver, said propulsion means including a motor mounted inside said body, and including an inverted U-shaped hollow air intake on said vehicle body behind said seat having an air intake opening, the ends of the intake communicating with said motor.

26. An aquatic vehicle comprising a narrow vehicle body including a centrally disposed seat for a driver, propulsion means for propelling the vehicle through the water, and lifting means disposed along the center line of said body for raising the position of said vehicle in the water as it is propelled forward, said lifting means including an inclined concave lifting surface formed in the lower surface of said body, said lifting means being effective to lift the center of gravity of said vehicle above the center of buoyancy, whereby said vehicle may be maintained in upright position while being propelled through the water by balancing of the driver, said propulsion means comprising a motor located in the vehicle body adjacent the rear end thereof and a depending drive shaft terminating in a propeller, and anti-torque means cooperating with said propeller, said anti-torque means including a cowling surrounding said propeller and a plurality of blades in said cowling behind said propeller, said blades being oriented to resist the torque resulting from turning of said propeller, said blades including a self-adjusting horizontal blade and a vertical blade supported by the cowling, said horizontal blade being pivotally mounted on the cowling so as to be inclined downwardly and rearwardly, and spaced stop means on the cowling limiting pivotal movement of the horizontal blade.

27. An aquatic vehicle comprising a narrow vehicle body including a centrally disposed seat for a driver, propulsion means for propelling the vehicle through the water, and lifting means disposed along the center line of said body for raising the position of said vehicle in the water as it is propelled forward, said lifting means including an inclined concave lifting surface formed in the lower surface of said body, said lifting means being effective to lift the center of gravity of said vehicle above the center of buoyancy, whereby said vehicle may be maintained in upright position while being propelled through the water by balancing of the driver, said lifting means comprising a tunnel surface formed as a part of the lower surface of said body, said tunnel surface opening in concave downward fashion, the side walls of said tunnel surface, at their outer edges, being angled downwardly and outwardly, and said tunnel surface comprising a smoothly curved funnel-like surface, with a forward portion of said surface having a greater perimeter than a rearward portion of said surface, said perimeters being measured in each case as the length of the line formed by the intersection of said surface with a vertical plane normal to the center line of said vehicle.

28. An aquatic vehicle comprising a relatively narrow body, a seat for a rider supported on said body, floatation means secured to said body and adapted to hold said body afloat when said body is in a stationary condition in the water, a steerable front ski secured to said body and adapted to support the forward portion of said body when said body is moving through the water, a manually operable steering member secured to said body and connected to said front ski, and a pair of wings extending laterally from the rear portion of said body for assisting in the support of the rear end of said body during movement thereof through the water, said front ski and said rear wings exerting a lifting force on said body during such movement which is sufficient to raise said body so that said floatation material is out of contact with the water, said rear wings extending outwardly from said body on both sides thereof to span a distance approximately equal to the length of said wings, said front ski having a width approximately equal to its length, said front ski incorporating a centrally disposed vertically depending fin, and said front ski including a concave downwardly opening surface, said surface having a generally plane central portion, extending longitudinally of said ski, and downwardly sloping portions joined to both sides of said central portion.

* * * * *

UNITED STATES PATENT AND TRADEMARK OFFICE

CERTIFICATE OF CORRECTION

PATENT NO. : 4,135,470
DATED : January 23, 1979
INVENTOR(S) : Hiroshi Ono

It is certified that error appears in the above-identified patent and that said Letters Patent are hereby corrected as shown below:

The patent has been assigned to:

Control Grinding Corporation,
Chicago, Ill.

Signed and Sealed this

*Twenty-fifth* Day of *September 1979*

[SEAL]

*Attest:*

*Attesting Officer*

LUTRELLE F. PARKER
*Acting Commissioner of Patents and Trademarks*